US005497879A

United States Patent [19]

Kao

[11] Patent Number: 5,497,879

[45] Date of Patent: Mar. 12, 1996

[54] FILM STATUS CAP

[76] Inventor: Richard C. Kao, 6244 Fallbrook Rd., Eden Prairie, Minn. 55344

[21] Appl. No.: 320,176

[22] Filed: Oct. 7, 1994

[51] Int. Cl.[6] ..... B65D 85/67; B65D 43/06; B65D 51/12

[52] U.S. Cl. ..... 206/389; 206/407; 206/459.1; 215/230; 220/212; 220/355

[58] Field of Search ..... 206/389, 407, 206/455, 316.1, 459.1; 215/230, 228; 220/352, 355, 212; 40/311, 310

[56] References Cited

U.S. PATENT DOCUMENTS

| | | | |
|---|---|---|---|
| D. 333,617 | 3/1993 | Brown . | |
| 3,004,684 | 10/1961 | Lightburn | 220/260 |
| 3,791,514 | 2/1974 | Watanabe | 206/407 X |
| 4,616,750 | 10/1986 | Nouwen | 206/389 |
| 4,801,011 | 1/1989 | Desdoigts . | |
| 4,860,892 | 8/1989 | Roberts et al. | 206/389 |
| 4,964,513 | 10/1990 | Ingram . | |
| 5,031,786 | 7/1991 | Ingram et al. | 215/230 |
| 5,278,600 | 1/1994 | Takahashi . | |

*Primary Examiner*—Bryon P. Gehman
*Attorney, Agent, or Firm*—Palmatier, Sjoqusit & Helget

[57] ABSTRACT

Disclosed is a film canister with an invertible cap having a first side and a symmetrical second side. Each side has oppositely facing circular engagement channels and are each engageable with a body portion that is sized for receiving and containing a roll of film. The first side and second side each have indicia indicative of "EXPOSED" and "UNEXPOSED" respectively to provide a convenient means of identifying the status of a roll of film contained in the canister. The cap is simply engaged on the body portion with the appropriate indicia displayed.

13 Claims, 1 Drawing Sheet

FILM STATUS CAP

BACKGROUND OF THE INVENTION

This invention relates to film canisters. More particularly it relates to photographic film canisters with indicating means to show the status of the film in the container.

Film canisters, particularly 35 mm film canisters, are utilized to store and protect rolls of film before usage, after usage, and prior to processing. The canisters are typically made of injection molded plastic and are generally considered disposable after use. Typically such canisters do not have any means for indicating whether the film inside the canister is used or unused. The user must open the canister and check to see if the leader section of the film is extending out of the roll. If for some reason the integrity of the packaging of the roll of film has been compromised, such as opening of the canister, the film can be exposed. Where several rolls of exposed and unexposed film are stored together, the opening process may be repeated several times to find an unexposed roll of film.

U.S. Pat. No. 4,964,513 to Ingram et al. discloses a film canister in which a label may be removed to expose indicia indicating that the film has been used. The Ingram invention does not disclose any means for reusing said film canister and requires additional steps in manufacturing to attach the labeling with the indicia to the canister cap.

A simple canister is needed to provide a means of determining whether the film inside the canister is exposed or unexposed. The means should be simple and ideally not require any additional steps in manufacturing of the canister.

SUMMARY OF THE INVENTION

Disclosed is a film canister with an invertible cap having a first side and a symmetrical second side. Each side has oppositely facing circular engagement channels and are each engageable with a body portion that is sized for receiving and containing a roll of film. The first side and second side each have indicia indicative of "EXPOSED" and "UNEXPOSED" respectively to provide a convenient means of identifying the status of a roll of film contained in the canister. The cap is simply engaged on the body portion with the appropriate indicia displayed.

An advantage and object of the invention is that the status of a roll of film in the container can be determined by observing the indicia on the cap without removal of the cap.

A feature of the invention is that both the first side and the second side of the cap are equivalent with respect to the engagement characteristics. This results in identical attachment and sealing characteristics with either the first side or second side of the cap facing outwardly. Moreover, the dimensions and volume of the interior of the canister is the same with either the first side or second side of the cap exposed.

An additional advantage and object of the invention is that insert labels may be placed into recesses located on both the first side and the second side of the caps to provide the "EXPOSED" and "UNEXPOSED" indicia and other desired information.

An additional object and advantage of the invention is that the cap provides an outer circumferential surface suitable for additional indicia such as a brand name.

An additional feature of the invention is that one invertible cap can simultaneously engage and seal two body portions in a tandem manner. This provides a convenient way of storing two rolls of film together in a single package either before or after use.

An additional object and advantage of the invention is that the cap may be reused. Moreover, the cap may be used to replace the caps on existing conventional film canisters.

DETAILED DESCRIPTION OF THE PREFERRED EMBODIMENTS

Figure 1:
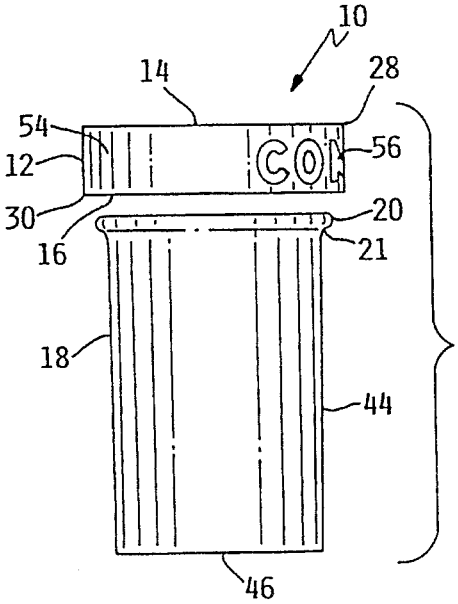
FIG. 1 shows a side elevational view of the film canister.

Referring to FIG. 1, a side elevational view of the invention is shown and is generally designated as numeral 10. The invention principally comprises a cap 12 with a first side 14 and a second side 16 which fastens to a body portion 18 at a lip 20 which is formed on an edge portion 21 of the body portion 18.

Figure 2:
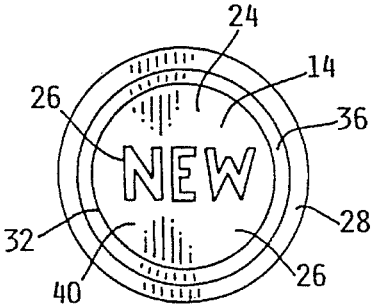
FIG. 2 shows a plan view of the first side of the cap showing a "NEW" indicia.
Figure 3:
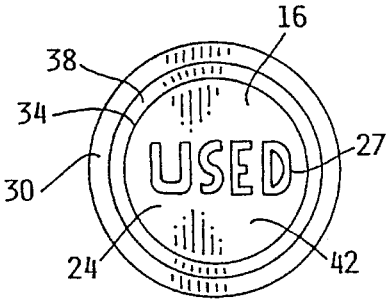
FIG. 3 shows a plan view of the second side of the cap showing a "USED" indicia.

Referring to FIGS. 2 and 3, the first and second sides 14, 16 of the cap 12 are shown. The cap has a center portion 24 upon which indicia such as "NEW" and "USED" 26, 27 are disposed by way of raised lettering on the center portion or other suitable means. In all other respects the first side 14 of the cap and second side 16 of the cap 12 are identical and symmetrical with each other. Both sides 14, 16 have an engaging member 28, 30 for engaging the edge portion or lip 20 of the body portion 18, and concentric lip abutment members 32, 34. The lip engaging members and lip abutment members 32, 34 define respective lip receiving channels 36, 38 on each side 14, 16 of the cap 12. The lip abutment members 32, 34 and the center portion 14 define opposing circular recesses 40, 42.

Figure 4:
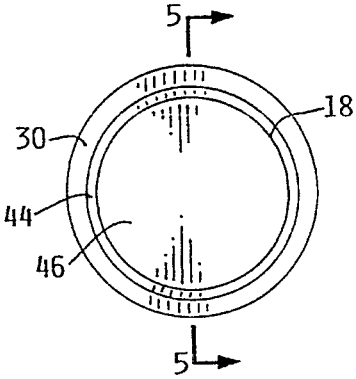
FIG. 4 shows a bottom view of the film canister with the cap in place.

FIG. 4 shows a bottom view of the film canister with the cap 12 in place on the body portion 18.

Figure 5:
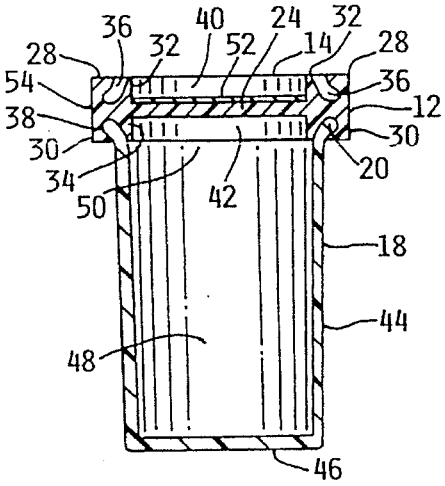
FIG. 5 shows a cross-sectional view of the film canister with the cap in place taken at line 5—5 of FIG. 4.

FIG. 5 shows the various features of the cap 12 in an engagement relationship with the body portion 18. The body portion 18 has a wall portion 44 and an end portion 46 which define an open interior 48. The open interior 48 is accessed through an open end 50 of the body portion 18 when the cap 14 is removed. The open interior is suitably proportioned for a particular size of film.

Continuing to refer to FIG. 5, the open end 46 is shown to be closed by the cap 12 with the lip engaging member 28 of the first side engaging the lip 20 of the body portion 18. The lip 20 is configured to be received by the channels 36, 38 between the lip engaging members 28, 30 and the lip abutment member 32, 34. As shown in FIG. 5, the elements on the first side 14 of the cap 12 are essentially identically to the elements on the second side 16. This provides equivalent sealing, engagement, and enclosure characteristics when either side is engaged with the body portion and further permits the utilization of two body portions with one cap 12.

Continuing to refer to FIG. 5, an insert label 52 is shown in place in the circular recess 40. The insert label 52 is sized to be received in either or both of the circular recesses 40, 42 of the cap 12. The insert label 52 may be of a somewhat rigid material such as cardboard or plastic and sized to be frictionally retained in place in the recess 40 by the lip abutment member 32. Alternately, the insert label 52 may be attached to the center portion 24 with a suitable adhesive. The indicia 26, 27 indicative of unexposed or exposed may be disposed on the insert label 52 rather than, for example, by way of raised or depressed lettering on the center portion 24. The insert label 52 may suitably have additional information such as product origin and film speed.

FIGS. 5 and well as FIG. 1 also shows a outer circumferential surface 54 on the cap suitable for other indica 56 such as a company or brand name.

The cap 12 and body portion 18 may each be molded by conventional injection molding techniques from suitable thermoplastic materials such as polyethylenes or the like. The indicia 26, 27 may be conveniently included on the mold.

The apparatus 10 may be used as follows: Referring to FIGS. 1–5, when received by the consumer, the film canister will have a unexposed roll, not shown, of film located in its interior 48. The cap 12 is removed by applying an upward pealing force to the lip engaging member 28 to remove said cap 12. The film may then be used, and when exposed, may be reinserted into the open interior 48 and the cap 12 may be inverted and engaged with the body portion 18 whereby the second side 16 displaying the indicia 27 indicative of "used" or "exposed" is facing outwardly.

The present invention may be embodied in other specific forms without departing from the spirit or essential attributes thereof. For example, the cap could be engageable with the body portion by way of complementary threads on the cap and at the edge portion of the body portion. The cap would be invertible with two sets of oppositely directed threads, each engageable with the threads on the body portion. It is therefore desired that the present embodiment be considered in all respects as illustrative and not restrictive, reference being made to the appended claims rather than to the foregoing description to indicate the scope of the invention.

What is claimed:

1. A film canister for containing film rolls, the canister comprising:

a) a body portion with an open interior and an open end for receiving and removing film rolls and further comprised of a edge portion surrounding the open end;

b) a cap for closing the open end, the cap comprised of a first side and a second side, a circular channel located on the first side and an oppositely facing second channel located on the second side, each channel sized to engage the cap with the edge portion of the body portion, whereby the cap is invertibly engageable on the body portion, and c) indicia disposed on at least one side of the cap indicative of the status of a film roll placed in said canister.

2. The film canister of claim 1, wherein the first side and second side of the cap each have indicia thereon, one of the indicia indicative of exposed and the other indicia indicative of unexposed.

3. The film canister of claim 2, wherein the cap is formed by injection molding and the indicia is molded into the cap.

4. The film canister of claim 1, wherein the opposing sides of the cap are structurally the same whereby engagement characteristics of either side of the cap to the body portion is the same and whereby the volume of the open interior is the same with either side of the cap engaged to the body portion.

5. The film canister of claim 1, wherein the cap has an outer circumferential surface.

6. The film canister of claim 1, wherein the cap has opposing circular recesses on each side and wherein each recess is concentric with the respective channel.

7. The film canister of claim 6 further comprising a label insert having indicia thereon, the label insert inserted into one of the circular recesses, said indicia indicative of the status of film roll placed in said container.

8. A film canister cap for a film canister body portion wherein the body portion is hollow and generally cylindrical having a closed end, an open end, and a lip surrounding the open end, the cap comprising a center portion, a first side and a second side symmetrically configured with respect to the first side, each side having a circular lip engagement member sized to the lip of the body portion whereby the open end of the body portion may be closed, whereby the lip is engageable with either the lip engagement member on the first side or the lip engagement member on the second side, whereby the engagement characteristics of either side of the cap to the body portion are substantially the same.

9. The film canister cap of claim 8 further comprising indicia on both the first and second side of the cap, each indicia indicative of film status.

10. The film canister cap of claim 8, wherein the cap is formed by injection molding and the indicia is molded into the cap.

11. The film canister cap of claim 8 further comprising two oppositely facing lip abutment members extending from said center portion, one of the opposing faces having indicia indicative of film status, the lip abutment members each defining a circular recess, the indicia disposed on the center portion within the circular recess.

12. The film canister cap of claim 11, wherein the circular lip engagement members define a circumferential surface on the cap.

13. A film canister comprising:

a) a body portion having an open interior, an open end, a closed end, and an edge portion at the open end;

b) a disk-shaped cap for closing the open end, the cap having a first side, a second side symmetrical to the first side, an engagement member located on the first side and another engagement member on the second side, the engagement members each sized to engage the edge portion and close the open end of the body portion; and c) indicia indicative of exposed film on one of said sides of the cap.

* * * * *